United States Patent [19]

Mosell

[11] Patent Number: 4,801,333

[45] Date of Patent: Jan. 31, 1989

[54] METHOD OF CLEANING ARTICLES IN A TANK

[76] Inventor: Carl G. Mosell, Sitio de Calahonda, Mijas Costa, Malaga, Spain

[21] Appl. No.: 675,421

[22] Filed: Nov. 26, 1984

Related Application Data

[63] Continuation of PCT SE84/00104 filed Mar. 23, 1984.

[30] Foreign Application Priority Data

Mar. 24, 1983 [SE] Sweden ..... 8301624

[51] Int. Cl.[4] ..... B08B 3/10

[52] U.S. Cl. ..... 134/7; 15/3; 51/437; 134/96; 134/186

[58] Field of Search ..... 15/3; 134/7, 96, 186; 51/436, 437, 263; 8/158; 68/29

[56] References Cited

U.S. PATENT DOCUMENTS

| | | | |
|---|---|---|---|
| 3,012,262 | 12/1961 | Mori | 15/3 |
| 3,183,120 | 5/1965 | Mori | 15/3 X |
| 3,323,159 | 6/1967 | Ummel | 15/3 |
| 3,395,412 | 8/1968 | Derwin | 15/3 |
| 3,425,078 | 2/1969 | Lazaga | 15/3 |
| 4,374,443 | 2/1983 | Mosell | 15/3 |

FOREIGN PATENT DOCUMENTS

| | | | |
|---|---|---|---|
| 47722 | 10/1972 | Finland . | |
| 608083 | 7/1926 | France . | |
| 54-459 | 4/1979 | Japan . | |
| 731117 | 6/1955 | United Kingdom | 51/436 |

*Primary Examiner*—Philip R. Coe

*Attorney, Agent, or Firm*—Merchant, Gould, Smith, Edell, Welter & Schmidt

[57] ABSTRACT

Method in a cleaning machine wherein liquid is circulated alternatively with and without granules entrained therein, which are heavier than the liquid, liquid and granules or liquid only being drawn from a tank (11) by means of a pump (15) to be discharged therefrom under pressure towards the goods to be cleaned and is then allowed to flow back to the tank. Then, liquid only will be drawn from the tank at a level spaced above the surface (21) of a bottom layer (14) of granules in the tank while liquid and granules will be drawn from the bottom layer in the tank through a bottom outlet (17) of the tank. The invention also relates to a cleaning machine for working the method having an open-ended sleeve (29) which is guided to be vertically displaced between a position with the lower end engaging the bottom (12) of the tank (11) around a bottom outlet (17), and another position with the lower end lifted from the bottom.

4 Claims, 2 Drawing Sheets

METHOD OF CLEANING ARTICLES IN A TANK

This is a continuation of application Ser. No. PCT/SE84/00104, filed Mar. 23, 1984.

The invention relates to a method in a cleaning machine wherein liquid is circulated alternatively with and without granules entrained therein, which are heavier than the liquid, liquid and granules or liquid only being drawn from a tank by means of a pump to be discharged therefrom under pressure towards the goods to be cleaned and being allowed then to flow back to the tank.

Cleaning machines which function according to this principle are provided with some type of retaining means such as a grid or a sieve in the circulation system of the liquid for separating the granules from the circulating liquid as desired. Means may be arranged to pass the liquid alternatively through the retaining means or past said means through a shunt line, or the retaining means may be adjustable between a position in which it extends as a closed valve across a flow passage for the liquid so as to retain the granules, and another position in which it is "open" in the passage such that the granules are not prevented from passing through said passage past the retaining means.

These known arrangements operate satisfactorily, but it is endeavoured to reach a simpler arrangement and above all to eliminate the use of a sieve or a similar retaining means, because there may be a tendency of clogging of the sieve or of the granules stagnating in the sieve at a shocklike increase of the liquid flow. Moreover, elimination of the retaining means may lead to a simpler construction of the cleaning machine.

Figure 1:
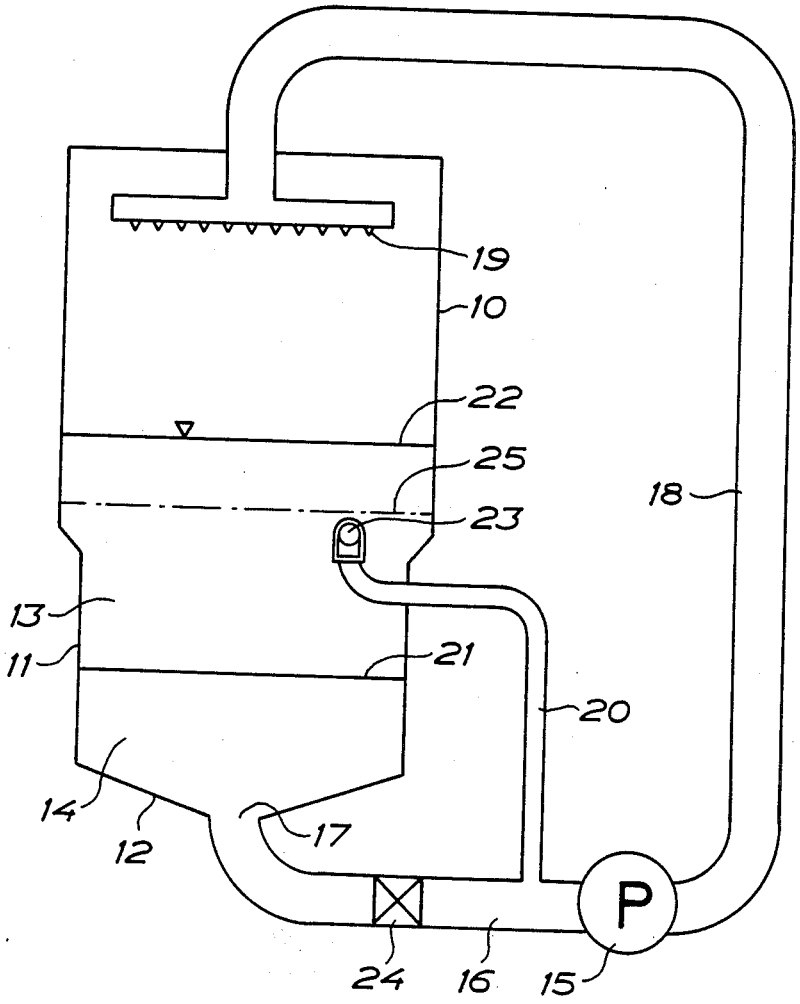
Figure 2:
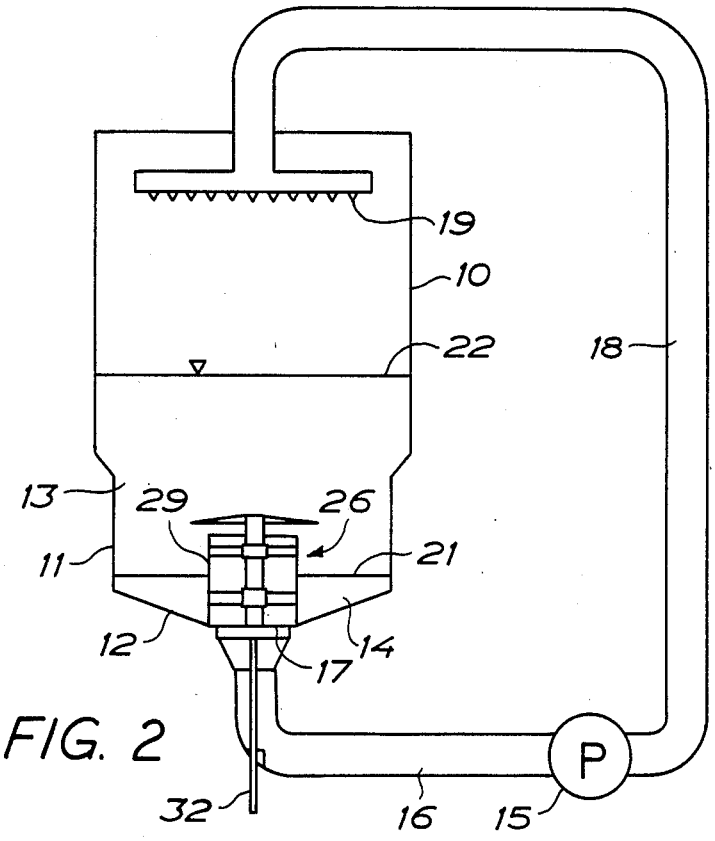
Figure 3:
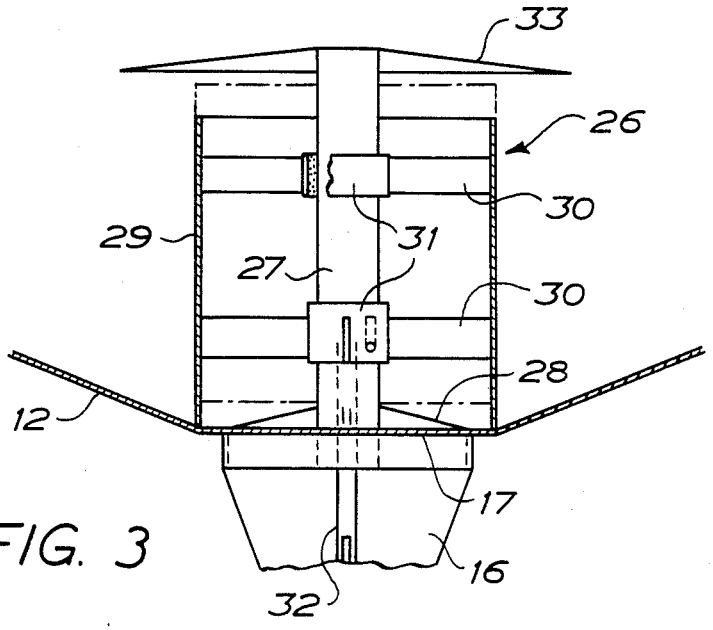

The invention relates to a contribution in this direction, and according to the invention the method referred to above has obtained the characteristics described herein For explanation of the invention in more detail reference is made to the accompanying drawing in which FIG. 1 is a very diagrammatic vertical sectional view of a cleaning machine for working the method of the invention, FIG. 2 is a similar vertical sectional view of a modified embodiment of the cleaning machine for working the method of the invention, and FIG. 3 is an enlarged vertical sectional view of a bottom valve of the embodiment shown in FIG. 2.

The cleaning machine shown in FIG. 1 comprises a treatment chamber 10 for the goods to be cleaned. E.g. heavily soiled goods to be washed may be involved. The lower portion of the treatment chamber, indicated at 11, can be separated from the treatment chamber proper by a transverse partition and can communicate with the treatment chamber through an outlet opening in this transverse partition, but the lower portion can also as shown in the drawing directly merge into the treatment chamber proper. The portion 11 has a conical or pyramidical bottom 12 and forms a tank for receiving a supply of liquid 13 (water) and a supply of granules 14 (plastic balls, sand or the like). A pump 15 coupled to an electric motor as shown herein is connected at the suction side of the pump by a conduit 16 to a central bottom outlet 17 in the bottom 12 of the tank, the pressure side of the pump being connected by a conduit 18 to stationary or movable nozzles 19 at the top and/or the sides of the treatment chamber 10, said nozzles being directed towards the goods to be cleaned for rinsing the goods by means of liquid only or for "blasting" the goods by means of liquid with granules entrained therein.

A branch conduit 20 is connected to the conduit 16, and this branch conduit has a cross-sectional area which is smaller than that of the conduit 16 as well as that of the conduit 18, the cross-sectional areas of said latter conduits being equal. The branch conduit opens in the tank 11 at a position which is located above the surface 21 of the bottom layer of granules 14, which is present in the tank when the machine is not operating, but is located below the liquid surface 22 when the totally available amount of liquid under the same conditions is received in its entirety by the tank 11. The conduit 20 has a float valve 23 at the opening inside the tank, and a closure valve 24 is provided in the conduit 16 between the bottom outlet 17 and the position where the conduit 20 connects to the conduit 16.

The conduit 16 allows a larger flow than the conduit 20. E.g. a flow of 1,600 l/min can be allowed by the conduit 16 while a flow of 1,000 l/min only is allowed by the conduit 20. When the valve 24 is closed the pump 15 will draw liquid from the tank 11 through the conduit 20. Due to the liquid flow through this conduit the liquid level in the tank 11 will not sink below the indicated level 25. Thus, liquid only will be pumped for rinsing the goods in the treatment chamber 10.

If the valve 24 is now opened, the pump 15 will draw from the tank 11 through the conduit 16, and due to the large flow allowed by the conduit 16 the level in the tank 11 will sink below the level at which the conduit 20 is closed off by means of the float valve 23. Accordingly, granules as well as liquid will now be circulated such that the goods in the treatment chamber 11 will be "blasted".

The only measure that has to be taken for shifting between rinsing by means of liquid only and "blasting" by means of liquid and granules is that the valve 24 has to be closed and opened, respectively. The float valve 23 can be dispensed with and as a substitute for the valve 24 a threeway valve can be arranged where the conduits 16 and 20 join each other.

The level fluctuations in the tank 11 will be dependent on the amount of liquid or liquid and granules received in the conduit system during the circulation, and the circulation system accordingly must be dimensioned with due consideration thereof.

In FIG. 2, the same reference numerals are used as in FIG. 1. In this embodiment the conduit 20 and the valve 24 are replaced by a bottom valve 26 which is shown in more detail in FIG. 3. The valve comprises a stationary tube 27 projecting vertically centrally of the bottom outlet 17 and is attached to said outlet by means of a spider 28. An open-ended cylindrical sleeve 29 concentric with the tube and having a diameter which is larger than that of the bottom outlet is guided by means of spiders 30 and mounting sockets 31 for vertical movement on the tube 27 between the lower position shown and an upper position indicated by dot-and-dash lines. The displacement is effected by means of an operating bar 32 which is extended through the conduit 16 connected to the bottom outlet, in a suitable manner. The tube 27 has at the top end thereof a conical metal sheet 33 covering the sleeve 29.

When the sleeve is in the lower position shown by solid lines it seals against the bottom 12 around the bottom outlet 17 such that the granules 14 will be retained on the bottom while the pump 15 draws liquid only through the top end of the sleeve. If the sleeve is lifted by means of the bar 32 to the position shown by dot-and-dash lines, the pump can draw granules and liquid through the opening left between the sleeve and the bottom.

I claim:

1. A method of cleaning articles in a tank, containing a liquid at a first predetermined level and a layer of granules at a second predetermined level within and below said first level, the tank having an inlet and a first outlet in said tank located below the first but above the second predetermined level, and a second outlet below said second predetermined level and including valve means for controlling the flow from said first and second outlet, comprising the steps of:

a: drawing liquid from said first outlet, b: discharging the liquid towards the article to be cleaned, c: opening said valve means to allow flow of liquid and granules from the second outlet, d: discharging the liquid with the granules entrained therein towards the article to be cleaned, and e: alternately performing steps a, b, c and d until the article is cleaned.

2. A method of cleaning articles in a tank, containing a liquid at a first predetermined level and a layer of granules at a second predetermined level within and below said first level, the tank having an inlet and a first outlet in said tank located below the first but above the second predetermined level, and a second outlet below said second predetermined level and including valve means for controlling the flow from said first and second outlet, comprising the steps of:

a: drawing liquid from said first outlet, b: discharging the liquid towards the article to be cleaned, c: opening said valve means to allow flow from the second outlet, d: drawing liquid entrained with granules from said second outlet at a flow rate greater than said first outlet, e: discharging the liquid entrained with granules towards the article to be cleaned, and f: alternately performing steps a, b, c, d and e until the article is cleaned.

3. A method of cleaning articles in a tank, containing a liquid at a first predetermined level and a layer of granules at a second predetermined level within and below said first level, the tank having an inlet and a first outlet in said tank located below the first but above the second predetermined level, and a second outlet below said second predetermined level and including valve means for controlling the flow from said first and second outlet, comprising the steps of:

a: opening said valve means to allow flow from the second outlet, b: drawing liquid entrained with granules from said second outlet, c: discharging the liquid entrained with granules toward the article to be cleaned, d: drawing liquid from said first outlet at a flow rate less than the second outlet, e: discharging the liquid towards the article to be cleaned, and f: successively repeating steps a, b, c, d and e until the article is cleaned.

4. A method of cleaning articles in a tank, containing a liquid at a first predetermined level and a layer of granules at a second predetermined level within and below said first level, the tank having an inlet and a first outlet in said tank located below the first but above the second predetermined level, and a second outlet below said second predetermined level and including valve means having an actuatable sleeve, for controlling the flow from said first and second outlet, comprising the steps of:

a: drawing liquid from said first outlet, b: discharging the liquid towards the article to be cleaned, c: actuating said sleeve to allow flow from the second outlet, d: drawing liquid entrained with granules from said second outlet, e: discharging the liquid entrained with granules from towards the article to be cleaned, and f: successively repeating steps a, b, c, d and e until the article is cleaned.

* * * * *

UNITED STATES PATENT AND TRADEMARK OFFICE

CERTIFICATE OF CORRECTION

PATENT NO. : 4,801,333

DATED : 31 January 1989

INVENTOR(S) : Carl G. Mosell

It is certified that error appears in the above-identified patent and that said Letters Patent is hereby corrected as shown below:

Column 4, line 41, delete the word "from".

Signed and Sealed this

Twenty-fifth Day of July, 1989

*Attest:*

*Attesting Officer*

DONALD J. QUIGG

*Commissioner of Patents and Trademarks*